US005455398A

United States Patent [19]

Martin et al.

[11] Patent Number: 5,455,398

[45] Date of Patent: Oct. 3, 1995

[54] MOUNTING SUPPORT FOR ELECTRICAL SWITCHES AND ASSOCIATED LEGEND PLATES

[75] Inventors: Adolf H. Martin; Robert P. Healy, both of Glenview, Ill.

[73] Assignee: Inventio AG, Hergiswil NW, Switzerland

[21] Appl. No.: 164,441

[22] Filed: Dec. 9, 1993

[51] Int. Cl.[6] ..... H01H 9/08

[52] U.S. Cl. ..... 200/296; 200/308

[58] Field of Search ..... 200/308, 296, 200/295, 294, 308, 309, 310, 314; 248/27.1, 27.3

[56] References Cited

U.S. PATENT DOCUMENTS

| | | | |
|---|---|---|---|
| 4,191,874 | 3/1980 | Bedel | 200/308 X |
| 4,504,713 | 3/1985 | Hennessey | 200/241 |
| 4,554,618 | 11/1985 | Bafunno et al. | 200/296 X |
| 4,560,972 | 12/1985 | Britt | 200/294 X |
| 4,742,198 | 5/1988 | Martin et al. | 200/296 |
| 4,758,724 | 7/1988 | Osika | 200/315 |
| 5,201,409 | 4/1993 | Martin et al. | 200/345 |

FOREIGN PATENT DOCUMENTS

| | | |
|---|---|---|
| 0446487 | 9/1991 | European Pat. Off. . |
| 2629256 | 9/1989 | France . |
| 7407773 | 7/1974 | Germany . |
| 3014477 | 10/1981 | Germany . |

OTHER PUBLICATIONS

IBM Technical Disclosure Bulletin, No. 9 Vol. 20. Feb. 1978.

*Primary Examiner*—Renee S. Luebke

*Attorney, Agent, or Firm*—Sandler, Greenblum & Bernstein

[57] ABSTRACT

Mounting support for electric switches and associated legend plates. The mounting support includes a housing for an electrical switch and a housing cover affixed to the housing, with threaded bolts for affixing the housing and housing cover to the indicator board, wherein the housing cover includes a lateral projecting arm extending laterally on one side of the housing, this projecting arm being adapted to adjoin a rear-face of the indicator board, with a legend plate being laterally carried by the projecting arm and being adapted to be positioned within an opening in the indicator board, with a threaded nut retaining the legend plate relative to the projecting arm.

2 Claims, 1 Drawing Sheet

MOUNTING SUPPORT FOR ELECTRICAL SWITCHES AND ASSOCIATED LEGEND PLATES

BACKGROUND OF THE INVENTION

1. Field of the Invention

The present invention pertains to a mounting support for electrical switches and legend plates associated therewith, that are mounted on an indicator board, wherein the switches include a housing and a housing cover, the latter adjoining the back face of the indicator board, with the housing and the housing cover being bolted to the indicator board.

2. Discussion of the Background of the Invention and Material Information

Electric switches, for example in the form of push button switch assemblies, are often used in elevators, where they are utilized in the cars as car call transmitters or are utilized at the floors as floor call transmitters. The push button switch assemblies and the associated legend plates, that is the legend plates showing the respective floor number, are attached at an indicator board. The push button switch assemblies used for these purposes are, due to frequent actuation by elevator users, exposed to high loads or stresses, so that they must be built correspondingly ruggedly. In addition, these switches and legend plates must be attached at the indicator board in a manner such that unintended damages or damages caused by vandalism can be avoided.

The push button switch assembly set forth in U.S. Pat. No. 4,504,713 fulfills the previously noted requirements and includes a housing and a housing cover, the latter directly adjoining the rear face of the indicator board. The housing cover includes an annular projection, whose height is substantially the same as the thickness of the indicator board, which engages with a circular cutout of the indicator board. The push button of the push button switch assembly is slidably guided, in a bore concentric with the annular projection, in a manner such that the push button does not extend beyond the indicator board. The housing and the housing cover are provided with overlapping bosses having apertures for the reception of threaded bolts which in turn are welded onto the indicator board and serve for the attachment of the push button switch assembly.

Though not further described in the previously noted patent, adjacent to the push button switch assembly, a legend plate is also commonly attached to the indicator board. The legend plate can take the form of a thin, rectangular, metal plate having a threaded bolt welded thereto for attachment purposes. The inscription on the legend plate is for example, the number of the respective floor. The indicator board includes a rectangular recess, produced generally via embossing or pressing, of the size of the legend plate, and a smaller substantially rectangular cutout, within the recess, whose side edges are provided with ledges or protrusions. This recess is so dimensioned however that the legend plate does not extend beyond the front plate. The ledges serve for the location and support of a washer shoved over the threaded bolt during the attachment of the legend plate.

A particular drawback of the previously described attachment manner of the legend plate lies in that, for the manufacture of the recess and the cutout, several working steps are required that must be carried out on different machines, thus incurring relatively high production costs.

SUMMARY OF THE INVENTION

It is an object of the present invention to provide a mounting support of the initially noted type which does not suffer from the drawbacks of the prior art and by means of which the legend plate can be installed more quickly and less expensively.

Specifically, this object is achieved by a mounting support for electric switch assemblies and legend plates associated therewith, with the mounting support, electrical switch assemblies and legend plates being disposed at an indicator board; the switch assemblies including a housing and a housing cover, with the housing cover adjoining a rear face of the indicator board and wherein the housing and the housing cover together are bolted to the indicator board; the housing cover including a lateral projecting arm on one side of the housing, with the projecting arm adjoining the rear face of the indicator board; a legend plate being laterally carried by the projecting arm within an opening in the indicator board; and means for retaining the legend plate relative to the projecting arm, the retaining means preferably including a threaded bolt, with the threaded bolt being attached to the legend plate and extending through an aperture within the projecting arm.

In one embodiment of the invention, the projecting arm includes a pedestal, with the pedestal extending into an opening in the indicator board and the height of the pedestal being less than the thickness of the indicator board. The legend plate is superimposed on and overlays the pedestal.

The projecting arm includes two parallel extending reinforcing walls, each having a contact surface, the reinforcing walls adjoining the housing by means of the contact surfaces, the contact surfaces being vertically extended, relative to the indicator board.

The mounting support of the invention further includes an adaptor, located in a region of the switch between the housing cover and a rear surface of the indicator board, with the adaptor including a flange which overlays the housing cover; a projection on the one side of the flange, the projection being guided within a recess of the housing cover; and a further annular projection on the other side of the flange, the further annular projection, whose height is substantially the same as the thickness of the indicator board, extending into a circular cutout of the indicator board.

The advantages achieved by the present invention reside in that only a simple opening, for the legend plate, is required in the indicator board, so that the production costs of the indicator board can be reduced considerably. Since the legend plates can already be attached to the laterally projecting arm prior to the installation of the switch, a separate delivery thereof is avoided, so that time and costs can be reduced at final assembly. The use of two reinforcing walls of the projecting arm, which abut the housing, achieves that even upon the influence of strong forces upon the legend plate, no deformations can occur in the housing cover.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF A PREFERRED EMBODIMENT

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 2:
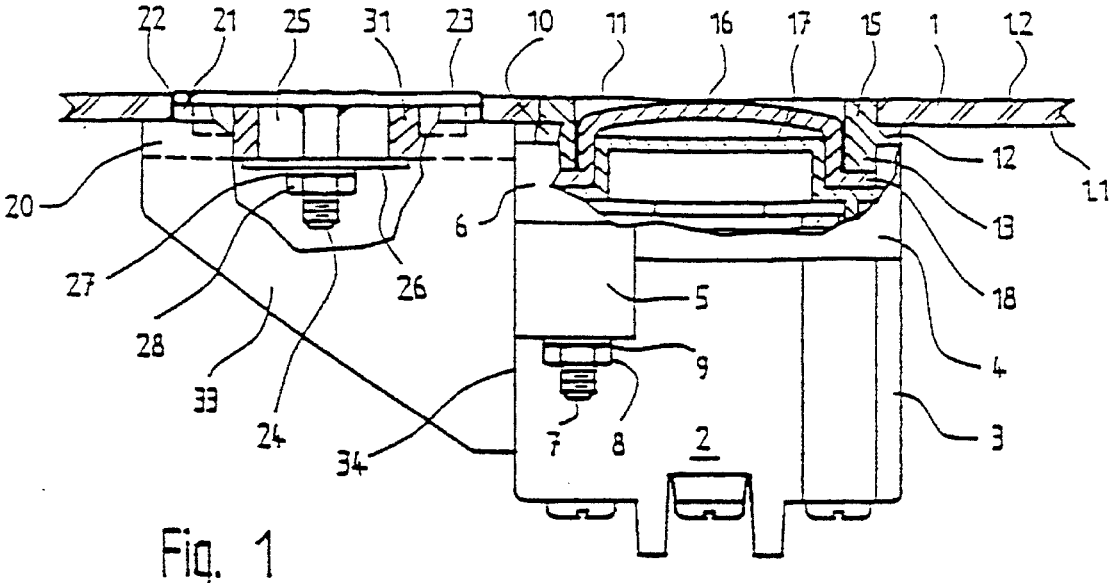
FIG. 2 is a top plan view, with portions broken away and in section, of the mounting support of this invention in an increased scale, in comparison to that of FIG. 1.
Figure 1:
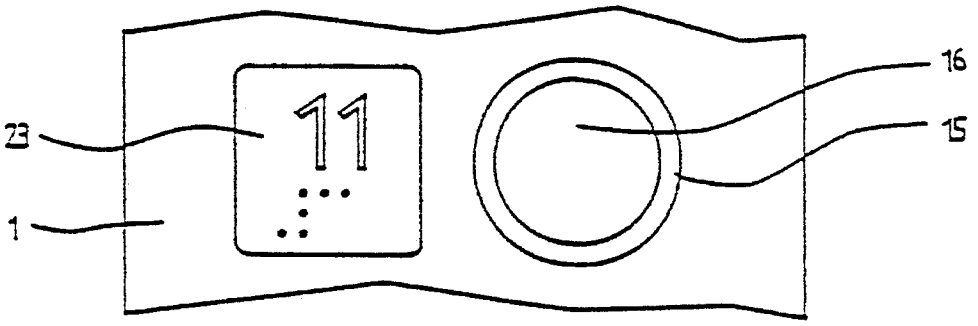
FIG. 1 is a partial view of an indicator board with a built-in switch having a legend plate.
Figure 3:
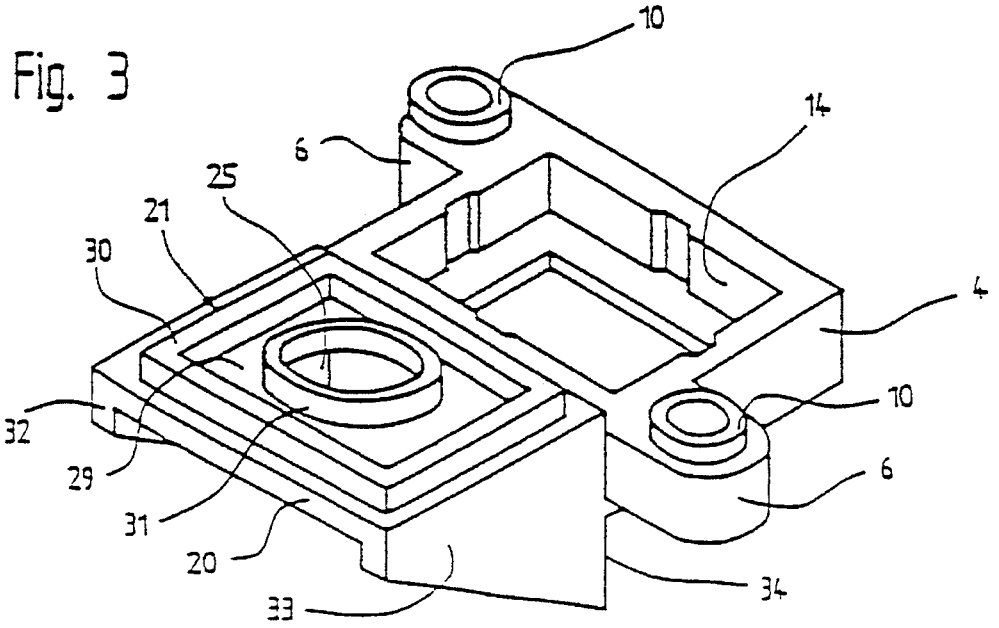
FIG. 3 is a perspective representation of housing cover of the mounting support as per FIG. 2.

Illustrated in FIGS. 1–3 is an indicator board 1 which, for example, is mounted in elevator cars or at the floors or landings next to the hoistway doors. An electrical switch assembly, for example, taking the form of a push button switch assembly 2, is attached on indicator board 1. Push button switch assembly 2 is enclosed in a housing 3 and housing cover 4 which adjoins back face 1.1 of indicator board 1, with the housing 3 and housing cover 4 preferably being constructed of plastic. A typical push button switch assembly 2 which can be utilized is of the type, set forth in previously noted U.S. Pat. No. 4,504,713, which satisfies the particular requirements of elevators. Housing 3 and housing cover 4 are provided with overlapping bosses 5 and 6 which include apertures for receiving threaded bolts 7 that are welded onto indicator board 1 and by means of which push button switch assembly 2, via the use of nuts 8 and lock washers 9, is attached to the indicator board 1.

Bosses 6 of housing cover 4 include eyelets 10 which adjoin back face 1.1 of indicator board 1, through which, in the region of push button switch assembly 2, a space is provided which substantially corresponds to the axial extent or height of eyelets 10. An adaptor 11 is received upon the housing cover 4 and has a flange 12 whose thickness corresponds at least to the height of eyelets 10. As shown in FIG. 2, the adaptor 11 preferably includes a flange 12 between a projection 13 on one side of the adaptor, which is guided within a recess 14 of housing cover 4, and a further annular projection 15, extending in an opposite side of the adaptor. The annular projection 15 has a height which is substantially the same as the thickness of indicator board 1 and extends into a circular cutout of indicator board 1.

A lens cap 16 is superimposed over a push button 17 of push button switch assembly 2. Thus, lens cap 16, and therewith push button 17, is slidably guided or retained in a circular opening of adaptor 11 that is concentric with annular projection 15. Lens cap 16 includes a margin 18 which rests against projection 13 of adaptor 11, by means of which an end position of push button switch assembly 2 is formed. In this position, lens cap 18 does not extend beyond the front face 1.2 of indicator board 1.

Housing cover 4 includes a jib or lateral projecting arm 20 on one side thereof which adjoins back face 1.1 of indicator board 1. Projecting arm 20 includes a pedestal 21 which extends into an opening 22 of indicator board 1, with the height of pedestal 21 being less than the thickness of indicator board 1. Pedestal 21 carries a legend or indicia plate 23 which is guided, on its sides, within opening 22. Pedestal 21, opening 22 and legend plate 23 all are preferably square in shape and of substantially similar size.

The thickness of legend plate 23, which is preferably constructed of metal, is approximately the same as the difference between the thickness of indicator board 1 and the height of pedestal 21, so that plate 23 does not extend beyond front face 1.2 of indicator board 1. Indicator plate 23 can, for example, be lettered with a floor number in normal numerals and in braille lettering, with the numerals preferably being embossed. Legend plate 23 preferably has a threaded bolt 24 welded thereto, the latter extending through an aperture 25 in projecting arm 20 and by means of which legend plate 23, via the use of a washer 26, a lock washer 27 and a nut 28, is bolted to projecting arm 20. Pedestal 21, via a recess 29, is preferably shaped so as to have, at its edge, a square extending ledge 30 and a circular extending ledge 31 therewithin, the latter enclosing aperture 25. Projecting arm 20 includes two parallel extending reinforcing walls 32, 33 that adjoin or abut housing 3 via their vertically extending, relative to indicator board 1, contact surfaces 34, so that upon the influence of strong forces upon legend plate 23, no deformation can occur in housing cover 4.

The mounting support of the present invention is also suitable for different types of switches, such as for example, rotary switches, key-operated switches, toggle switches and so forth. It is also possible to utilize this mounting support for other electrical structural blocks, such as for example indicator lamps. The legend or indicia plates are not restricted to a square shape. Thus, it is possible to so shape the mounting support that legend plates of rectangular or other shapes can be attached.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A mounting support for electric switches and legend plates associated with said electric switches, said mounting support, electrical switches and legend plates being adapted to be disposed at an indicator board, said mounting support comprising:

a housing for an electrical switch;

a housing cover affixed to said housing;

means for affixing said housing and housing cover to the indicator board;

said housing cover including a lateral projecting arm extending laterally on one side of said housing, said projecting arm being adapted to adjoin a rear face of the indicator board;

a legend plate being laterally carried by said projecting arm and being adapted to be positioned within an opening in the indicator board; and means for retaining said legend plate relative to said projecting arm;

wherein said projecting arm includes two parallel, generally triangular, extending reinforcing walls, each having a contact surface, said reinforcing walls adjoining said housing by means of said contact surfaces, said contact surfaces being vertically extending, relative to said indicator board.

2. A mounting support for electric switches and legend plates associated with said electric switches, said mounting support, electrical switches and legend plates being adapted to be disposed at an indicator board, said mounting support comprising:

a housing for an electrical switch;

a housing cover affixed to said housing;

means for affixing said housing and housing cover to the indicator board;

said housing cover including a lateral projecting arm extending laterally on one side of said housing, said projecting arm being adapted to adjoin a rear face of the indicator board;

a legend plate being laterally carried by said projecting arm and being adapted to be positioned within an opening in the indicator board;

means for retaining said legend plate relative to said projecting arm;

an adaptor, located in a region of said switch between said housing cover and a rear surface of the indicator board; and wherein said indicator board includes a circular cutout and said adaptor includes:

a flange which overlays said housing cover;

a projection on the one side of said flange, said projection being guided within a recess of said housing cover; and a further annular projection on the other side of said flange, said further annular projection, whose height is substantially the same as the thickness of said indicator board, being adapted to extend into a circular cutout of the indicator board.

* * * * *